US005240242A

United States Patent [19]

Ando et al.

[11] Patent Number: 5,240,242

[45] Date of Patent: Aug. 31, 1993

[54] SHEET FEEDING DEVICE

[75] Inventors: Masao Ando; Kazushi Watanabe, both of Yokohama; Kanji Yano, Kawasaki, all of Japan

[73] Assignee: Canon Kabushiki Kaisha, Tokyo, Japan

[21] Appl. No.: 725,620

[22] Filed: Jul. 3, 1991

[30] Foreign Application Priority Data

Jul. 5, 1990 [JP] Japan ..... 2-178065
Jul. 12, 1990 [JP] Japan ..... 2-182739

[51] Int. Cl.[5] ..... B65H 3/06

[52] U.S. Cl. ..... 271/118; 271/116; 271/127

[58] Field of Search ..... 271/116, 118, 121, 127, 271/117, 126

[56] References Cited

U.S. PATENT DOCUMENTS 4,087,178 5/1978 Pfeifer et al. .
4,319,740 3/1982 Ulseth .
4,346,878 8/1982 Aizawa .
4,488,718 12/1984 Tamura ..... 271/118
4,717,139 1/1988 Sootome et al. ..... 271/118 X

FOREIGN PATENT DOCUMENTS 3013605 10/1980 Fed. Rep. of Germany .
2348877 11/1977 France .
189945 11/1982 Japan ..... 271/127
61-111239 5/1986 Japan .
247333 10/1989 Japan ..... 271/118

*Primary Examiner*—Robert P. Olszewski
*Assistant Examiner*—Boris Milef
*Attorney, Agent, or Firm*—Fitzpatrick, Cella, Harper & Scinto

[57] ABSTRACT

A sheet feeding device includes a sheet accommodation unit for supporting a plurality of sheets, the sheet accommodation unit being movable between waiting and sheet feed positions, an urging device for urging the sheet accommodation unit toward the sheet feed position, a sheet feed device for sending out the sheets supported by the sheet accommodation unit at the sheet feed position, a moving device for moving the sheet accommodation unit between the waiting and sheet feed positions, a driving force transmitting device for transmitting a driving force of moving the sheet accommodation unit to the moving device when engaged with the displacing device, a release device for releasing the engagement of the displacing device with the driving force transmitting device, and a locking device for cancellably restricting the moving device when the engagement of the moving device with the driving force transmitting device is released by the release device.

27 Claims, 13 Drawing Sheets

SHEET FEEDING DEVICE

BACKGROUND OF THE INVENTION

1. Field of the Invention

The present invention relates to a sheet feeding device for feeding sheets loaded in sequence one at a time.

2. Related Background Art

FIGS. 12 to 14 show a conventional sheet feeding device.

The sheet feeding device includes a sheet feeding shaft 201 which is rotatably supported by right and left bearings (not shown) of a device body. A sheet feeding roller 202 is fitted on the sheet feeding shaft 201 with a cylindrical core 203 formed integrally with the sheet feeding roller 202 therebetween. The sheet feeding roller 202 and the cylindrical core 203 are rotatable relative to the sheet feed shaft 201 but not movable along the sheet feeding shaft 201. The sheet feeding roller 202 and the cylindrical core are made of, for example, a rubber.

A clutch gear 209 is fitted on the sheet feeding shaft 201 at the right end portion thereof, as viewed in FIGS. 12 to 14, in such a manner as to be rotatable relative to the shaft 201 but not movable along the shaft 201. A driving gear 211 driven by a motor (not shown) meshes with the clutch gear 209 so as to allow the rotational force in a counterclockwise direction indicated by an arrow 'a' in FIG. 12 to be transmitted to the clutch gear 209.

A spring winding drum 209*a* is formed integrally with and coaxially with respect to the clutch gear 209. A spring winding drum 207*a* is coaxially fixed to the sheet feeding shaft 201 adjacent to the spring winding drum 209*a*. Both the spring winding drums 209*a* and 207*a* have substantially the same diameter. A clutch spring 219*a* is coiled over the spring winding drums 201 and 207*a*, and a one-revolution control ring 206*a* is loosely fitted on the clutch spring 219*a*. One end portion 291*c* of the clutch spring 219*a* is locked to the spring winding drum 207*a*, and the other end portion 219*d* is locked to the control ring 206*a*. The control ring 206*a* has on its outer surface a claw portion 206*b*, which can be engaged with and disengaged from a first claw portion 212*a*.

The spring winding drums 209*a* and 207*a*, the clutch spring 219*a*, the control ring 206*a* and the claw portion 206*b* in combination constitute a known one-revolution spring clutch (hereinafter referred to as "a first spring clutch B").

The cylindrical core 203 of the sheet feeding roller 202 extends from the right end portion of the sheet feeding roller 202. A spring winding drum 207*b* is coaxially fixed to the sheet feeding shaft 201 adjacent to the right end portion of the extending portion of the cylindrical core. The extending portion of the cylindrical core 203 and the spring winding drum 207*b* have substantially the same diameter. A clutch spring 219*b* is coiled over both the extending portion of the cylindrical core 203 and the spring winding drum 207*b*, and a control ring 208*a* is loosely fitted over the clutch spring 219*a*. One end portion 219*c* of the clutch spring 219*b* is locked to the extending portion of the cylindrical core 203, and the other portion 219*d* thereof is locked to the control ring 208*a*. The control ring 208 has claws 208*b* formed on the entire outer periphery thereof at a small pitch. A second claw portion 212*b* can be engaged with and disengaged from the claws 208*b*.

The cylindrical core 203, the spring winding drum 207*b*, the clutch spring 219*b*, the control ring 208*a* and the claw portions 208*b* in combination form a known spring clutch (hereinafter referred to as a second spring clutch C).

A cam 204 is fixed to the sheet feeding shaft 201 between the first and second spring clutches B and C.

A flapper 212 is attracted to and released from a solenoid 213. The flapper 212 has on its distal end side the first claw portion 212*a* which can be engaged with and disengaged from the claw portion 206*b* of the control ring 206*a* of the first spring clutch B, and the second claw portion 212*b* which can be engaged with and disengaged from the claw portions 208*b* of the control ring 208*a* of the second spring clutch C.

A sheet loading base 214 is disposed with a distal end side thereof being located below the sheet feeding roller 202. The sheet loading base 214 is urged by a pushing spring 216 in a direction in which the distal end side thereof approaches the under surface of the sheet feeding roller 202. Sheets S are loaded on the loading base 214.

A friction pad 215 for separating one sheet from the others is disposed downstream of and adjacent to the distal end portion of the sheet loading base 214 in a state in which it is in contact with the under surface of the sheet feeding roller 202 by a spring 217.

When sheets are not fed out, the solenoid 213 is off (deenergized), and the flapper 212 is pulled down by a spring (not shown) with its first and second claw portions 212*a* and 212*b* respectively engaged with the claw portions 206*b* and 208*b* of the control rings 206*a* and 208*a* of the first and second spring clutches B and C (the state indicated by the solid line in FIG. 13). Consequently, the control rings 206*a* and 208*a* are checked, and the first and second spring clutches B and C are thus off.

That is, in the first spring clutch B, the clutch spring 219*a* is loosely held on the spring winding drums 209*a* and 207*a* (in a clutch-off state). Consequently, the clutch gear 209 rotated by the driving gear 211 idles over the sheet feeding shaft 201, and no driving force is thus transmitted to the sheet feed shaft 201, i.e., the shaft 201 is maintained in non-rotating state.

In the second spring clutch C, the sheet feed shaft 201, i.e., the spring winding drum 207*b*, is not rotated. Also, the clutch spring 219*b* is loosely held (in the clutch-off state) on the spring winding drum 207*b* and the extending portion of the cylindrical core 203 of the sheet feeding roller 202, and the sheet feeding roller 202 is thereby maintained in a non-rotating state.

The cam 204 is positioned at a rotational angle at which the large-diameter portion thereof is directed downward. Consequently, the distal end of the large-diameter portion of the cam 204 is in contact with the upper surface of the sheet loading base 214, and the sheet loading base 214 is thereby pressed down to a predetermined pressed down position (FIG. 13) against the spring 216. In this state, the upper surface of the distal end portion of the sheets S loaded on the loading base 214 is separate from the under surface of the sheet feeding roller 202 by a distance '$\alpha$'.

When the solenoid 213 is turned off (energized) on the basis of a sheet feed starting signal, the flapper 212 is attracted to the solenoid 213, and the first and second claw portions 212*a* and 212*b* of the flapper 212 are respectively disengaged from the claw portions 206b and 208b of the control rings 206a and 208a of the first and second spring clutches B and C (the state indicated by the dot-dot-dashed line in FIGS. 12 and 13). Consequently, the control rings 206a and 208b are released, and the first and second spring clutches B and C are thereby turned on.

More specifically, in the first spring clutch B, when the control ring 206a is released, the clutch spring 219a is tightened on the spring winding drums 209a and 207a, and the clutch gear 209 which is rotating by the rotation of the driving gear 211 is thereby connected to the sheet feed shaft 201 through the spring winding drum 209a, the clutch spring 219a and the spring winding drum 207a, thereby rotating the sheet feed shaft 201 together with the clutch gear 209 in a direction indicated by 'a'.

In the second spring clutch C, as the control ring 208a is released, the clutch spring 219b is tightened on the spring winding drum 207b and the extending portion of the cylindrical core 203 of the sheet feed roller 202. Consequently, the spring winding drums 207b and the extending portion of the cylindrical core 203 are connected to each other, and the sheet feed roller 202 thereby starts rotating together with the sheet feed shaft 201 which has started rotating by the turning on of the first clutch spring B in a direction indicated by 'a'.

As the sheet feed shaft 201 rotates, the cam 204 formed integrally with the sheet feed shaft 201 also rotates, rotating the downward large-diameter portion thereof in a direction in which it is moved away from the upper surface of the sheet loading base 214. At the initial stage of the rotation of the large-diameter portion, pressing down of the sheet loading base 214 by the cam 204 is cancelled, and the sheet loading base 214 is thereby pushed up by the spring 216, bringing the upper surface of the distal end portion of the sheets A loaded on the sheet loading base 214 into contact with the under surface of the sheet feed roller 202 (FIG. 14).

Therefore, a feeding force is applied to the sheet located on the top of the sheet pile S loaded on the base 214 by the sheet feed roller 202 which has started rotating, and only the sheet located on the top of the pile is separated from the other sheets by the friction pad 215, and is fed out of the sheet loading base 214 between the sheet feeding roller 202 and the friction pad 215.

Thereafter, the sheet is further conveyed by register rollers 218 to a sheet receiving portion of an image formation unit. Between the sheet feed roller 202 and the register rollers 218, the sheet is guided by a sheet guide plate.

After the sheet has been fed out by the rotation of the sheet feed roller 202 and then accepted by the register roller 218 (within a time required for the sheet feed roller 202 to make one rotation), the solenoid 213 is turned off. Consequently, the flapper 212 is released from the solenoid 213, and the first and second claw portions 212a and 212b of the flapper 212 are respectively thereby moved down toward the control rings 206a and 208a of the first and second spring clutches B and C.

As a result, in the second spring clutch C, the claw portion 212b of the flapper 212 immediately comes into engagement with the claw portion 208b of the control ring 208a, thereby checking the control ring 208a and turning the clutch off. As a result, the sheet feed roller 202 is disconnected from the sheet feed shaft 201 and is thereby made free from the rotation of the sheet feed shaft 201.

In the first spring clutch B, after the control ring 206a has made one rotation, the claw portion 206b thereof is brought into engagement with the first claw portion 212a of the flapper 212 which is moving down toward the claw portion 206b, thereby checking the control ring 206a. As a result, the clutch is turned off, and the rotation of the sheet feed shaft 201 stops. That is, one-rotation drive of the sheet feed shaft 201 ceases. At that time, one rotation of the cam 204 also ceases and the cam 204 returns to its position where the large-diameter portion is directed downward. Therefore, the sheet loading base 214 is pressed down against the spring 216, and the sheets S loaded on the base 214 are separated from the sheet feed roller 202 by the distance 'a'.

Convey of the sheet continues due to the conveying force of the register rollers 218 even after the first and second spring clutches B and C have turned off. Since the cylindrical core 203 has been disconnected from the sheet feed shaft 201 by the turning off of the second spring clutch C and the sheet feed roller 202 has thereby been made free from the rotation of the sheet feed shaft 201, the sheet feed roller 202 and cylindrical core 203 are rotated over the shaft 201 by the conveying force of the register rollers 218 until the rear end of the sheet passes between the sheet feed roller 202 and the friction pad 215.

Among the two spring clutch mechanism B and C employed in the above-described sheet feed device, the first spring clutch mechanism B for rotating the cam 204 to move sheet loading base 214 up and down must have very accurate dimensions with respect to the spring winding drum and clutch spring. Furthermore, the assembly of the spring clutch mechanisms requires troublesome tasks, including coating of a grease and adjustment of the backlash of the winding drum in the thrust direction. These increase production cost.

FIGS. 15 and 16 show another conventional sheet feeding device.

A sheet feeding device shown in FIGS. 15 and 16 includes a sheet feed roller 250 made of a friction member, a driving shaft 215 for driving the sheet feed roller 250, and a spring clutch 256 mounted on one end of the driving shaft 251. The spring clutch 256 consists of a gear 252, a control ring 253, a spring 254 and a boss 255.

The driving shaft 251 is supported by a support plate 257 of an apparatus body through a bearing 258. The gear 252 is rotated by a drive force transmitted thereto from a drive source. The control ring 253 has on its outer peripheral surface a claw portion 253a which can be locked by an actuator (not shown) of a solenoid. The boss 255 is fixed to the driving shaft 251 by means of a vis 259.

The spring 254 is wound around both a ring portion 252a of the gear 252 and a ring portion 255a of the boss 255 in a direction in which the spring 254 tightens up on the ring portion 252a due to friction when the gear 252 is driven in a direction indicated by an arrow 'A'.

When the gear 252 is rotated in the direction indicated by the arrow 'A', the spring 254 thus tightens up on the ring portion 252a, allowing the drive force to be transmitted to the sheet feed roller 250 through the boss 255 and driving shaft 251. One end 254a of the spring 254 is locked to a groove portion 255b of the boss 255, and the other 254b thereof is locked to a notch portion 253b of the control ring 253.

Therefore, when the claw portion 253a of the control ring 253 is locked to the actuator, even if the gear 252 is rotated, the spring 254 is fitted loosely over the ring portion 252*a*, allowing the gear 252 alone to rotate with its ring portion 252*a* sliding against the spring 254.

As a result, rotation of the sheet feed roller 250 can be controlled by operating the actuator which is achieved by turning on and off of the solenoid (not shown).

However, the aforementioned conventional sheet feed device has the following drawbacks.

The ring portion 252*a* of the gear 252 must be made of a sintered material because of sliding of the spring 254 thereagainst. Also, the ring portion 252*a* must be coated with a lubricant oil. These increase production cost.

Furthermore, when transmission of the driving force is suspended by locking the claw portion 253*a* of the control ring 253 to the actuator, a load may be applied to the spring 254, thereby generating noises.

Furthermore, an idling torque is generated even while the driving force is not being transmitted. This may apply an excess load to the driving source.

SUMMARY OF THE INVENTION

An object of the present invention is to provide a sheet feeding device which has a simple structure to allow for reduction in the production cost, and which assures sufficient control accuracy.

To achieve this object, the present invention provides a sheet feeding device which comprises a sheet accommodation means for supporting a plurality of sheets, said sheet accommodation means being movable between waiting and sheet feed positions, an urging means for urging the sheet accommodation means toward the sheet feed position, a sheet feed means for sending out the sheets supported by the sheet accommodation means at the sheet feed position, a moving means for moving the sheet accommodation means between the waiting and sheet feed positions, a driving force transmission means for transmitting a driving force of moving the sheet accommodation means to the moving means when engaged with the moving means, a cancellation or release means for cancelling the engagement of the displacement means with the driving force transmission means, and a locking means for cancellably restricting the moving means, when the engagement of the moving means with the driving force transmission means is cancelled by the cancellation means. The moving means is brought into engagement with the driving force transmission means due to the urging force of the urging means when restriction of the moving means by the locking means is cancelled.

In this invention, when the sheets are fed, the moving means is moved utilizing the urging force of the urging means for urging the sheet accommodation means to the sheet feed position and is thereby brought into engagement with the driving force transmission means by cancelling restriction of the moving means by the locking means. Consequently, the moving means is driven, and the sheet accommodation means is thereby moved to the sheet feed position to make the sheet feed operation possible. In this structure, the use of the special parts is eliminated, and the structure is simplified. As a result, reduction in the production cost is made possible.

In a preferred construction, the moving means comprises a first cam having a cam portion for holding the sheet accommodation means to the waiting position which is separated from the sheet feed position, and a second cam portion for maintaining the sheet accommodation means to the sheet feed position located near the sheet feed means.

The cancellation means comprises a notched gear connected to the cam. The driving force is transmitted when a gear provided in the driving force transmission means is in mesh with the notched gear while transmission of the driving force is cancelled when the gear of the driving force transmission means becomes opposed to a notched portion of the notched gear.

The sheet accommodation means comprises a pivotal inner plate for loading the sheets. The urging means comprises a spring for urging the inner plate toward the sheet feed position. The cam is rotated by the spring so as to rotate the notched gear and thereby bring the notched gear into mesh with the gear when restriction of the cam by the locking means is cancelled.

In the sheet feeding device, when the urging force of the urging means for urging the sheet accommodation means to the sheet feed position is great, the following sheet feeding device may be used.

The sheet feeding device comprises a sheet accommodation means for supporting a plurality of sheets, said sheet accommodation means being movable between waiting and sheet feed positions, an urging means for urging the sheet accommodation means toward the sheet feed position, a sheet feeding means for sending out the sheets supported by the sheet accommodation means at the sheet feed position, a moving means for moving the sheet accommodation means between the waiting and sheet feed position, a first driving force transmission means for transmitting a driving force of moving the sheet accommodation means to the moving means when engaged with the displacement means, a cancellation or releases means for cancelling the engagement of the displacement means with the driving force transmission means, a locking member for restricting the displacement means when the engagement of the displacement means with the driving force transmission means is cancelled by the cancellation means, a lock release means for releasing restriction of the locking member by the driving force, and a second driving force transmission means for transmitting the driving force to the lock release means. Said moving means is brought into engagement with the driving force transmission means due to an urging force of the urging means when the lock release means cancels restriction of the moving means by the locking member using the driving force from the second driving force transmission means.

In this invention, when the sheets are fed, the moving means is displaced utilizing the urging force of the urging means for urging the sheet accommodation means to the sheet feed position and is thereby brought into engagement with the driving force transmission means by moving the locking member by the lock release means using the large driving force and thereby releasing restriction of the displacement means. Consequently, the moving means is driven and the sheet accommodation means is thereby moved to the sheet feed position to make the sheet feed operation possible. Since locking of the locking member is cancelled using the large driving force, even when the urging force of the urging means for urging the sheet accommodation means to the sheet feed position is great, reliable control is made possible.

In a preferred construction, the lock release means includes a cam having a cam portion for maintaining a state in which the locking member restricts the moving means and a cam portion for releasing restriction of the locking member by displacing the locking member, a second cancellation means for cancelling the engagement of the cam with the second driving force transmission means, and a locking means for restricting the cam when the engagement of the cam with the second driving force transmission means is cancelled by the second cancellation means.

The second cancellation means comprises a notched gear connected to the cam. The driving force is transmitted when a gear provided in the second driving force transmission means is in mesh with the notched gear, while transmission of the driving force is cancelled when the gear of the second driving force transmission means becomes opposed to a notched portion of the notched gear.

DETAILED DESCRIPTION OF THE PREFERRED EMBODIMENTS

Figure 1:
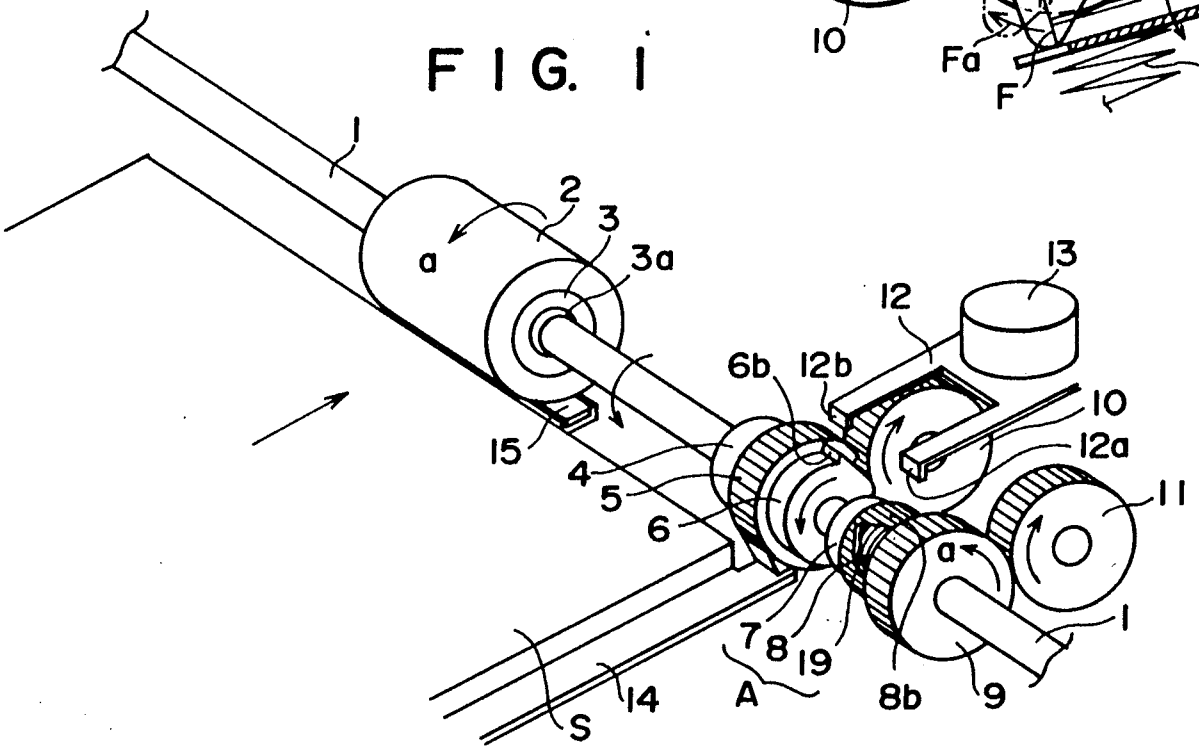
FIG. 1 is a perspective view of the essential parts of an embodiment of the present invention.

A first embodiment of the present invention will be described below with reference to FIGS. 1 to 3.

A clutch gear 9 which is rotated by the rotation of a driving gear 11 is connected to or disconnected from a sheet feed shaft 1 by means of a spring clutch A including a spring winding drum 9*a* formed integrally with the clutch 9, a spring winding drum 7 formed integrally with the sheet feed shaft 1, a clutch spring 19 and a control ring 8. The control ring 8 has a claw portion 8*b* formed on its overall outer peripheral surface at a small pitch. A claw portion of a flapper 12 can be engaged with or disengaged from the claw portion 8*b*.

A one-rotation control ring 6 having a single claw portion 6*b* on the outer periphery thereof and a cam 4 for moving up and down a sheet loading base 14 are formed on the two side of and integrally with a gear 5 whose teeth are partially notched or omitted.

This unit consisting of the notched gear 5, the control ring 6 and the cam 4 is fitted over the sheet feed shaft 1 in such a manner that it can be rotated but cannot be moved in the axial direction with respect to the sheet feed shaft 1. A second claw portion 12*b* of the flapper 12 can be engaged with or disengaged with the claw portion 6*b* of the control ring 6.

A driving gear 10 is in mesh with the notched gear 5. The driving gear 10 is driven by a motor (not shown) for driving the sheet feed shaft 1.

A sheet feed roller 2 is fixed to the sheet feed shaft 1 through a cylindrical core 3 and a ratchet (one-way clutch) 3*a* in such a manner as to be rotatable together with the shaft 1.

Figure 2:
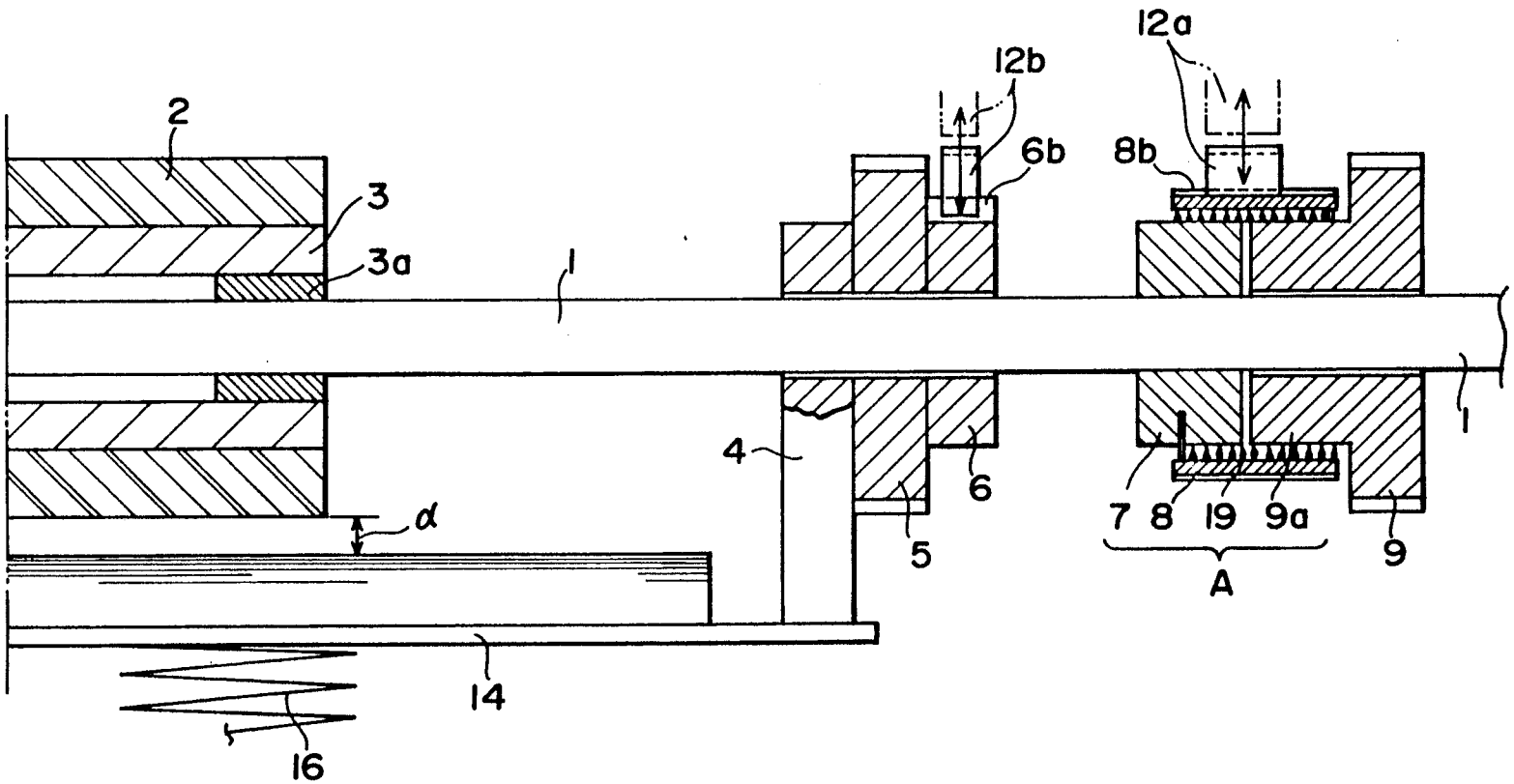
FIG. 2 is a longitudinal cross-sectional view of the embodiment of FIG. 1.

When no sheet is fed, the solenoid 13 is off (disengaged), and the first and second claw portions 12*a* and 12*b* of the flapper 12 are therefore respectively in engagement with the claw portion 8*b* of the control ring 8 of the spring clutch A and the claw portion 6*b* of the one-rotation control ring 6 which is formed integrally with the notched gear 5 (the state indicated by the solid line in FIG. 2).

Therefore, the spring clutch A is off. That is, the clutch gear 9 is idling on the sheet feed shaft 1 and no driving force is thus transmitted to the sheet feed shaft 1. Consequently, the shaft 1 and hence the sheet feed roller 2 and held non-rotating state.

The cam 4 is located at its rotational angle at which the large-diameter portion hereof is directed downward. Therefore, the sheet loading base 14 is pressed down to a predetermined position against a spring 16 by the large-diameter portion of the cam 4 whose distal end is in contact with the sheet loading base 14 (FIGS. 2 and 3). At that time, a moment Fa which tends to produce rotation of the cam 4 about the shaft 1 in a direction indicated by an arrow 'a' in FIG. 3 is generated due to the reaction F of the sheet loading base 14. However, the second claw portion 12*b* of the flapper 12 is in engagement with the claw portion 6*b* of the control ring 6, and movement of the cam 4 away from the sheet loading base 14 is thus prohibited. As a result, the sheet loading base 14 is held stably at the predetermined pressed down position, and the upper surface of the sheet S loaded on the sheet loading base 14 is thus separate from the sheet feed roller 2 by a distance '$\alpha$' (FIG. 2).

Figure 3:
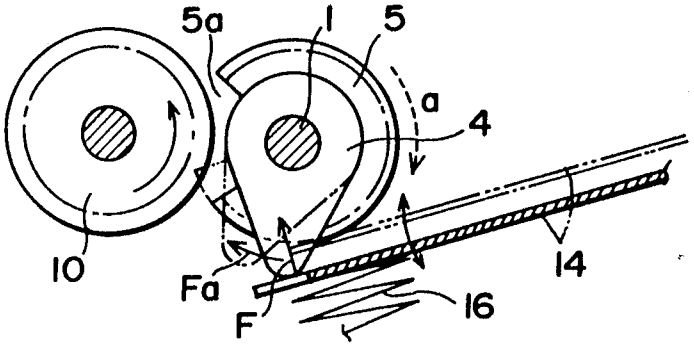
FIG. 3 is a lateral cross-section of the embodiment of FIG. 1.

When the cam 4 is located at the above-described rotation angle, the notched gear 5 is located with its notched portion 5*a* facing the driving gear 10 (FIG. 3). That is, the notched gear 5 is not in mesh from the driving gear 10, and no driving force is transmitted to the notched gear 5.

When the solenoid 13 is turned on (energized) on the basis of a sheet feed starting signal, the flapper 12 is attracted to the solenoid 13 and the first claw portion 12*a* of the flapper 12 is thereby disengaged from the claw portion 8*b* of the control ring 1 of the spring clutch A to turn on the clutch A while the second claw portion 12*b* is disengaged from the claw portion 6*b* of the one-rotation control ring 6 formed integrally with the notched gear 5 and cam 4. As the spring clutch A is turned on, the sheet feed shaft 1 is rotated together with the clutch gear 9 in a direction indicated by an arrow 'a'.

As locking of the one-rotation control ring 6 is cancelled, the cam 4 rotates about the shaft 1 in the direction indicated by the arrow 'a' due to the moment Fa generated as a consequence of the reaction F of the sheet loading base 14, thereby rotating the notched gear 5 and the one-rotation control ring 6 about the shaft 1 together with the cam 4. At the initial stage of the rotation of the cam 4, the lower end of the cam 4 moves away from the sheet loading base 14 and the pressing down of the sheet loading base 14 by the cam 4 is thereby cancelled.

Consequently, the sheet loading base 14 is pushed up by the spring 16, and the upper surface of the distal end portion of the sheet S loaded on the sheet loading base 14 is thereby brought into contact with the under surface of the sheet feed roller 2. Also, as the notched gear 5 is rotated in the direction indicated by the arrow 'a', it is brought into engagement with the driving gear 10. Thereafter, the notched gear 5 is rotated together with the cam 4 and the control ring 6 in the direction indicated by the arrow 'a' by the driving gear 10.

As the upper surface of the sheet S loaded on the sheet loading base 14 comes into contact with the under surface of the rotating sheet feed roller 2 as a consequence of the rise of the base 14, a feeding force is applied to the upper surface, and only the sheet located at the top of the sheet pile loaded on the sheet loading base 14 is thereby separated from the other sheets and fed out in cooperation with a friction pad 15. Thereafter, the sheet passes through register rollers and is then conveyed to a sheet receiving portion of an image forming section.

As the sheet fed out from the sheet loading base 14 by the rotation of the sheet feed roller 2 is received by the register rollers (not shown), the solenoid 13 is turned off. Consequently, the first claw portion 12*a* of the flapper is brought into engagement with the claw portion 8*b* of the control ring 8 of the spring clutch A to turn off the spring clutch A and thereby stop rotation of the sheet feed shaft 1.

After the spring clutch A has been turned off, conveyance of the sheet continues due to the conveying force of the register rollers. Also, after the spring clutch A has been turned off, the sheet feed roller 2 rotates over the sheet feed shaft 1 which is not rotating through the ratchet 3*a* due to the conveying force of the register rollers until the rear end of the sheet passes between the sheet feed roller 2 and the friction pad 15.

After the rotation of the sheet feed shaft 1 has been stopped by the turning off of the spring clutch A, the notched gear 5 continues rotating on the sheet feed shaft 1 together with the cam 4 and the control ring 6 in the direction indicated by the arrow 'a' due to the mesh with the driving gear 10. When the notched gear 5 has made substantially one rotation, the larger-diameter portion of the cam 4 becomes directed downward again. As a result, the sheet loading base 14 is pressed down against the spring 16 and the sheet S loaded on the base 14 is thereby separated from the sheet feed roller 2 by the distance '*a*' (FIG. 2).

As the notched gear 5 has been moved to a rotational angle at which the notched portion 5*a* faces the driving gear 10, the notched gear 5 is disengaged from the driving gear 10, and the notched gear 5 is no longer driven by the driving gear 10. However, the moment FA which tends to produce rotation of the cam 4 in the direction indicated by the arrow 'a' is generated due to the reaction F of the sheet loading base 14, and the cam 4, the notched gear 5 and the control ring 6 continue rotating altogether in the direction indicated by the arrow 'a'. During that rotation, the claw portion 6*b* of the one-rotation control ring 6 is brought into engagement with the second claw portion 12*b* of the flapper 12 which has been already lowered, by which rotation of the control ring is stopped.

That is, further rotation of the unit consisting of the cam 4, the notched gear 5 and the control ring 6 is prohibited, and the sheet loading base 14 is thereby stably held at its predetermined pressed-down state (FIGS. 2 and 3).

The above-described operation cycle is repeated each time a sheet feed starting signal is generated so as to feed the sheets in sequence one at a time.

In the above-described embodiment, the sheet feed roller 2 which is the sheet feeding means is fixedly located while the sheet loading base 14 is moved up and down by rotating the cam 4 by means of the driving means including the notched gear 5 each time a sheet is fed out. Conversely, the sheet loading base 14 may be fixedly positioned while the sheet feed roller 2 is moved up and down by rotating the cam 4 by means of the driving means including the notched gear 5 each time a sheet is fed out.

As will be understood from the foregoing description, in the sheet feed device according to this embodiment, since the cam for moving the sheet feed means and the sheet loading base closer to and away from each other each time a sheet is fed out is rotated by the driving means including the gear whose teeth are partially notched, the use of the spring clutch mechanism for rotating the cam can be eliminated. Consequently, a troublesome task, like assembly of the spring clutch, can be eliminated, thereby reducing production cost.

A second embodiment of the present invention will be described below with reference to FIGS. 4 to 8 which illustrate a laser beam printer to which the sheet feeding device according to the present invention is applied.

Figure 8:
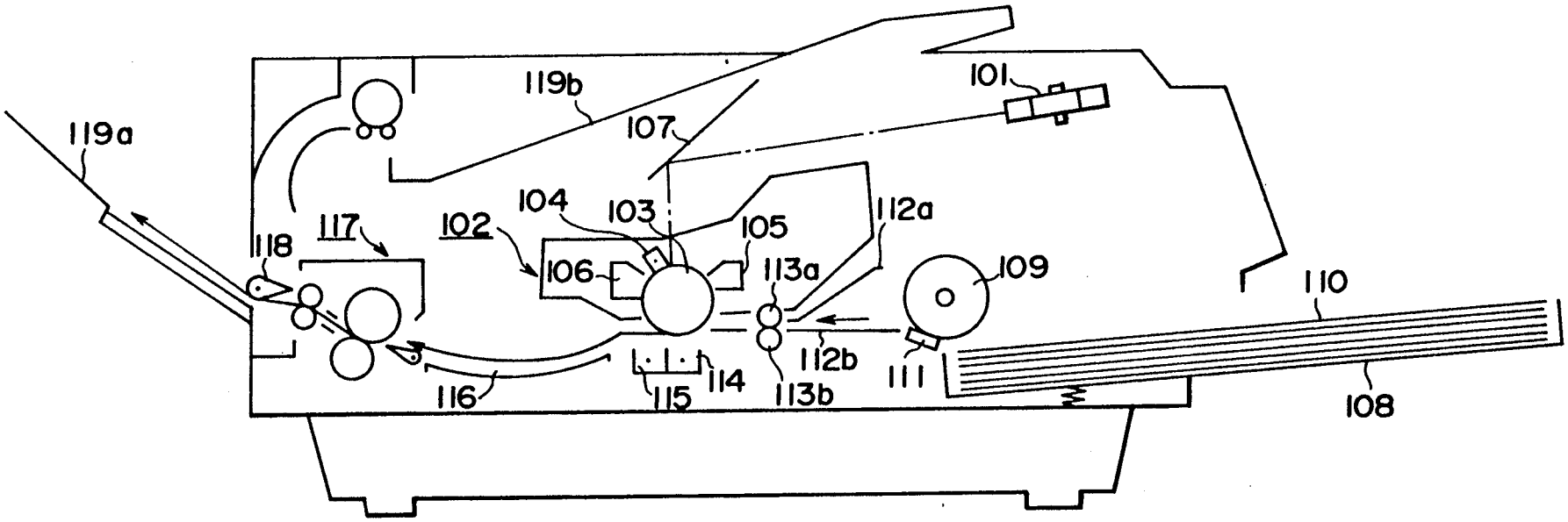
FIG. 8 is a cross-sectional view of a laser beam printer which incorporates the drive control mechanism of FIG. 4.

First, the structure of the laser beam printer will be schematically described with reference to FIG. 8.

A scanner unit 101 irradiates a laser beam in accordance with the recording information. A process cartridge 102 incorporates a recording means which includes a photo-sensitive drum 103 which is the image carrying body, a primary charger 104 which is a corona charger, a developer 105 in which toner is accommodated, and a cleaner 106.

The laser beam emitted from the scanner unit 101 is illuminated on the photo-sensitive drum 103 in the process cartridge through a reflection mirror 107. The photo-sensitive drum 103 is charged by the primary charger 104 beforehand. Therefore, illumination of the laser beam forms an electrostatic latent image. The latent image formed on the photo-sensitive drum 103 is developed by the developer 105 to form a visible toner image.

When a sheet 110 leaves a sheet feed cassette 108 by the feeding out operation of a sheet feed roller 109 which is the rotary sheet feeding body, it is separated from the other sheets by a separation pad 111 provided in opposed relation to the sheet feed roller 109. The separated sheet 110 is guided by upper and lower guide plates 112*a* and 112*b*, and then conveyed between register rollers 113*a* and 113*b* whose operation is temporarily suspended and which correct slanting of the sheet. Next, the sheet 110 is intermittently conveyed to a transfer portion by the register rollers 113*a* and 113*b* in such a manner that it can be aligned with the distal end of the toner image formed on the photo-sensitive drum 103.

A transfer charger 114 is provided to transfer the toner image formed on the photo-sensitive drum 103 onto the sheet 110. The transfer charger 114 charges the rear surface of the sheet 110 to a polarity opposite to that in which the toner is charged to transfer the toner image from the photo-sensitive drum 103 onto the sheet 110 in sequence. The sheet with the image transferred thereon by the transfer charger 114 is charged to a polarity opposite to that of the transfer charger 114 by a separation charger 115 to separate it from the photo-sensitive drum 103. The toner particles remaining on the photo-sensitive drum 103 are removed by the cleaner 106 for a subsequent recording.

The separated sheet 110 is conveyed to a fixer 117 by a conveying device 116 to fix the non-fixed transfer image to the sheet 110. The sheet 110 subjected to the fixing process is discharged on a discharge tray 119*a* or 119*b* via a conveying path selected by a flapper 118.

The drive control mechanism provided in the above-described laser beam printer will be described with reference to FIGS. 4 to 7.

Figure 4:
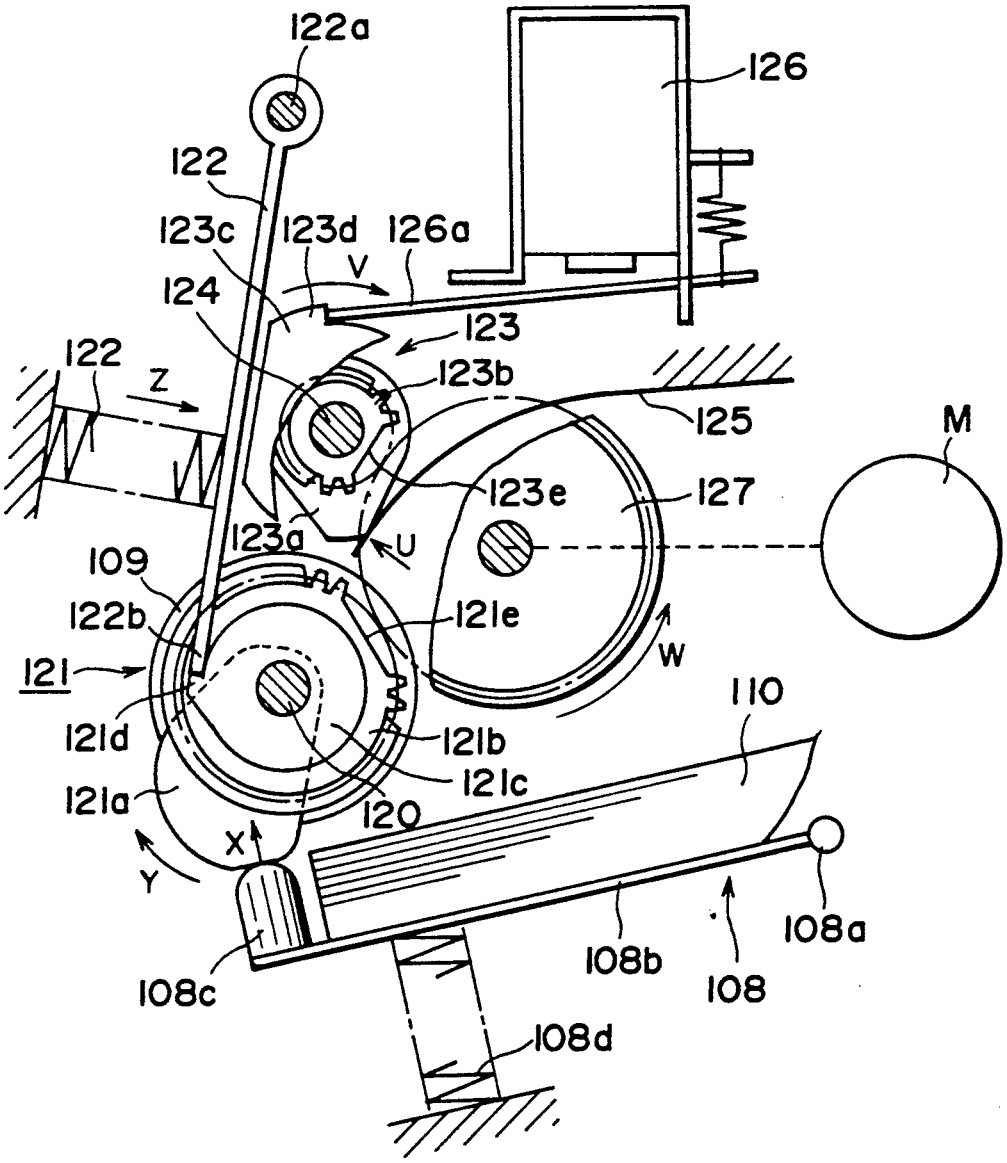
FIG. 4 is a cross-sectional view of a second embodiment, showing the drive control mechanism of a sheet feed roller.

Referring first to FIG. 4, an inner plate 108*b* is provided within the sheet feed cassette 108 in such a manner as to be rotatable about a shaft 108*a*. Sheets 110 are loaded on the inner plate 108*b*. A protrusion 108*c* is provided on the end portion of the inner plate 108*b* located on the downstream side thereof. The inner plate 108*b* is urged by a spring 108*d* in a direction indicated by an arrow 'X' from the rear surface thereof.

A sheet feed roller 109 is disposed above and downstream of the sheet 110 for feeding the sheets loaded on the inner plate 108*b*. The sheet feed roller 109 is made of a friction material. The sheet feed roller 109 is mounted fixedly on a driving shaft 120. The sheet feed roller 109 may be circular with or without a notch formed thereon. A first rotary member 121, consisting of a cam 121*a*, an operation gear 121*b* having a notch 121*e*, and a locking member 121*c* having a locking claw 121*d*, is mounted on one end of the driving shaft 120 as one unit.

The protrusion 108*c* provided on the inner plate 108*b* is in contact with the cam 121*a* and is thereby pressing the first rotary member 121 in a direction indicated by an arrow 'X', i.e., the protrusion 108*c* is applying to the first rotary member 121 a rotational force which rotates it in a direction indicated by an arrow 'Y'.

A stopper (a locking means) 122 is provided in such a manner as to be pivotal about a support 122*a*. The stopper 122 has a distal end portion 122*b* which is in engagement with the locking claw 121*d* of the locking member 121*c*. The stopper 122 is urged by a spring 122*c* in a direction indicated by an arrow 'Z' so that the distal end portion 122*b* can be made engaged with the locking claw 121*d*. Therefore, rotation of the first rotary member 121, which is pressed by the contact of the protrusion 108*c* with the cam 121*a* such that it can rotate in the direction indicated by the arrow 'Y', is prohibited by the locking of the locking claw 121*d* with the stopper 122.

A second rotary member 123 includes a cam 123*a*, an operation gear 123*b* having a notch 123*e*, and a locking member 123*c* having a locking claw 123*d* which are formed as one unit in such a manner as to be rotatable about a fixed shaft 124. A plate spring 125 is in contact with the cam 123*a* and is thereby urging the second rotary member 123 in a direction indicated by an arrow 'U'. Therefore, the second rotary member 123 is subjected to the rotational force in a direction indicated by an arrow 'V'.

A solenoid (a control means) 126 is provided to suspend or cancel suspension of rotation of the second rotary member 123. The solenoid 126 has an actuator 126*a* which can be engaged with the locking claw 123*d* of the locking member 123*c*. Therefore, rotation of the second rotary member 123, which is pressed by the contact of the plate spring 125 with the cam 123*a* such that it can rotate in the direction indicated by the arrow 'V', is prohibited by the locking of the actuator 126*a* to the locking claw 123*d*.

A transmission gear 127 is provided to transmit the rotational force of a driving motor M which is the driving source to both the first and second rotary members 121 and 123. The rotational force is transmitted when the transmission gear 127 is meshed with both the operation gears 121*b* and 123*b*. Normally, the transmission gear 127 is opposed to both the notched portions 121*e* and 123*e* of the operation gears 121*b* and 123*b*.

Therefore, in the initial position (home position), no driving force of the driving motor M is transmitted from the transmission gear 127 to the operation gears 121*b* and 123*b*. The number of teeth of the operation gear 123*b* is less than that of the operation gear 121*b* so as to allow the second rotary member 123 to be rotated faster than the first rotary member 121. The motor M may be or may not be a motor for driving the sheet feed roller 109.

The operation of the drive control mechanism arranged in the manner described above will be described with reference to FIGS. 5 to 7.

Figure 5:
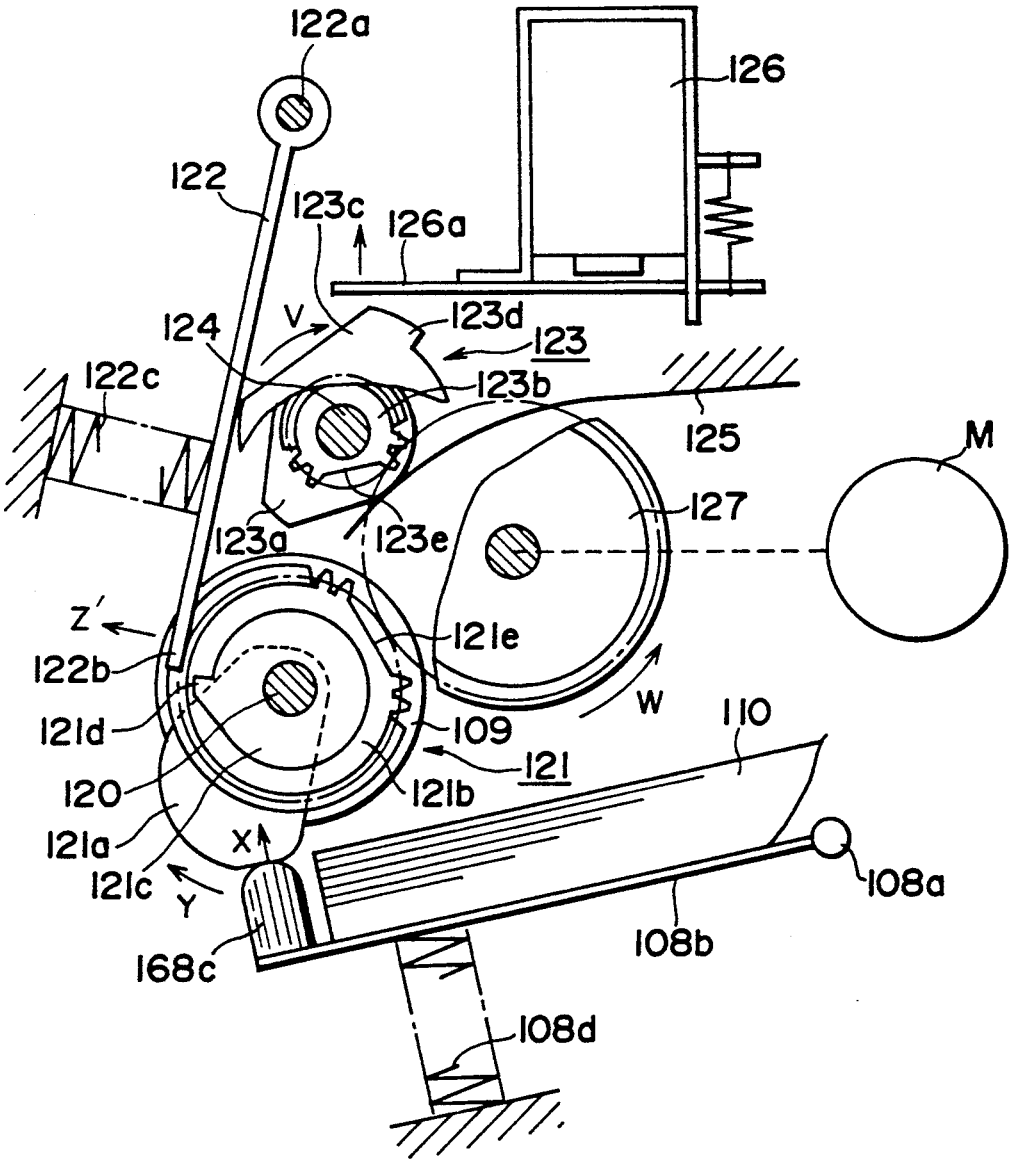
FIGS. 5 to 7 illustrate the operation of the drive control mechanism of FIG. 4.

Referring first to FIG. 5, when the driving motor M is operated, the transmission gear 127 rotates in a direction indicated by an arrow 'W'. At that time, both the first and second rotary members 121 and 123 are at their home position at which the notched portions 121*e* and 123*e* of the operation gears 121*b* and 123*b* are opposed to the transmission gear 127, and no driving force is thus transmitted from the transmission gear 127 to the first and second rotary members 121 and 123.

Next, the solenoid 126 is energized (turned on and then off) instantaneously (within the time required for the second rotary member 123 to make one rotation) to move the actuator 126 upward and thereby make it unlocked from the locking claw 123*d*. Consequently, the second rotary member 123 whose cam 123*a* is urged by the plate spring 125 starts rotating in the direction indicated by the arrow 'V'. When the operation gear 123*b* has come into mesh with the transmission gear 127, the driving force of the driving motor M is transmitted to the second rotary member 123, and the second rotary member 123 thus rotates.

As the second rotary member 123 rotates in the direction indicated by the arrow 'V', the locking member 123*c* also rotates in the same direction, pressing the stopper 122 in the direction indicated by an arrow 'Z' in FIG. 5 against the elastic force of the spring 122*c*. Consequently, the distal end portion 122*b* is disengaged from the locking claw 121*d* of the locking member 121*c*. Also, since the cam 121*a* is urged by the protrusion 108*c* provided on the inner plate 108*b*, the first rotary member 121 starts rotating in the direction indicated by the arrow 'Y'.

Figure 6:
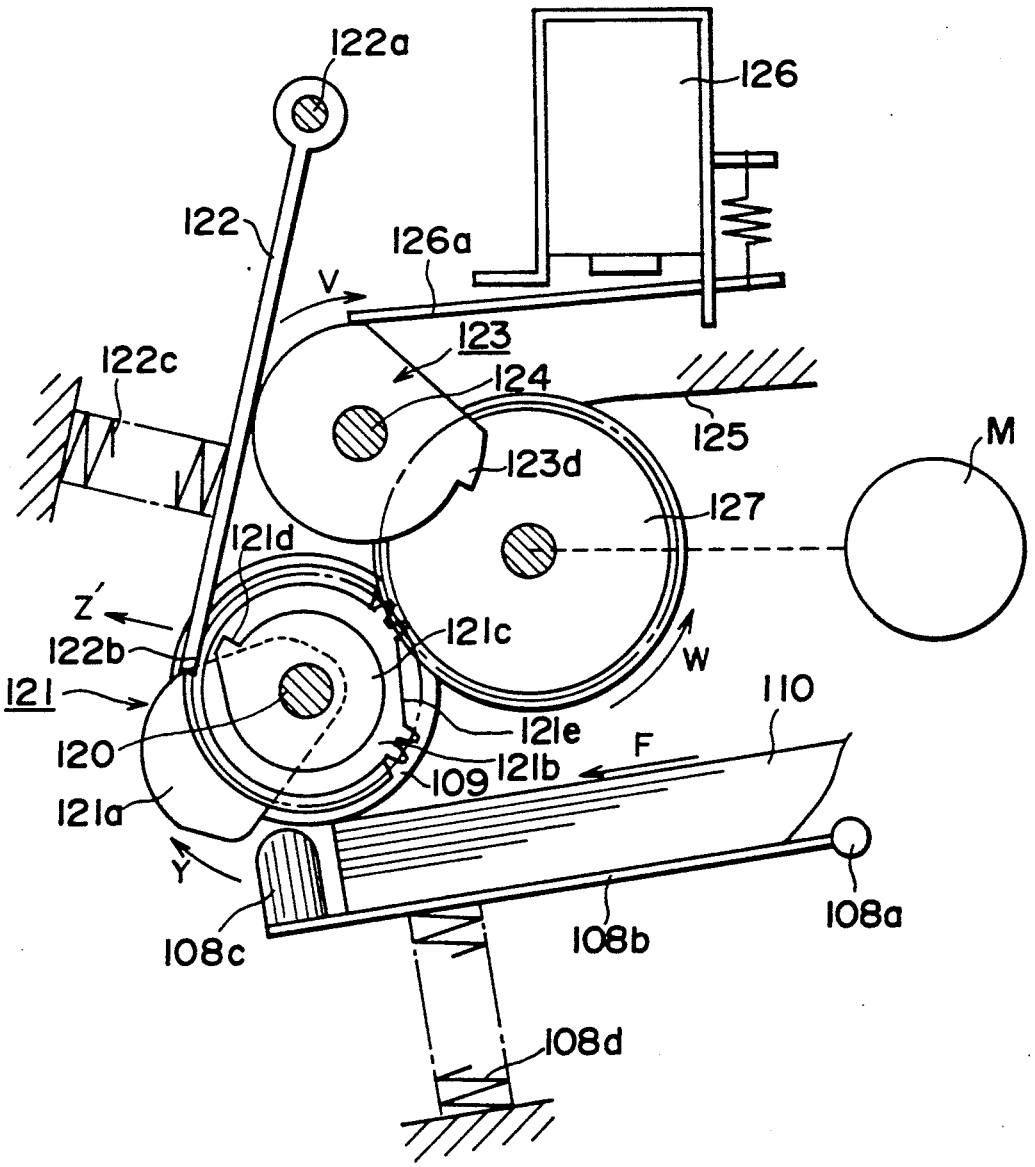

As the cam 121*a* is separated from the protrusion 108*c*, as shown in FIG. 6, the inner plate 108*b*, which is urged by the spring 108*d*, pivots about the support 108*b*, and thereby rises. In consequence, the lower end of the sheet 110 loaded on the inner plate presses against the sheet feed roller 109. Also, as the first rotary member 121 rotates, the operation gear 121*b* comes into mesh with the transmission gear 127, and the driving force of the driving motor M is thereby transmitted to the first rotary member 121 to rotate it. As a result, only the sheet 110, located at the top of the sheet pile and pressed by the sheet feed roller 109, is fed out in the downstream direction (indicated by an arrow 'F').

Figure 7:
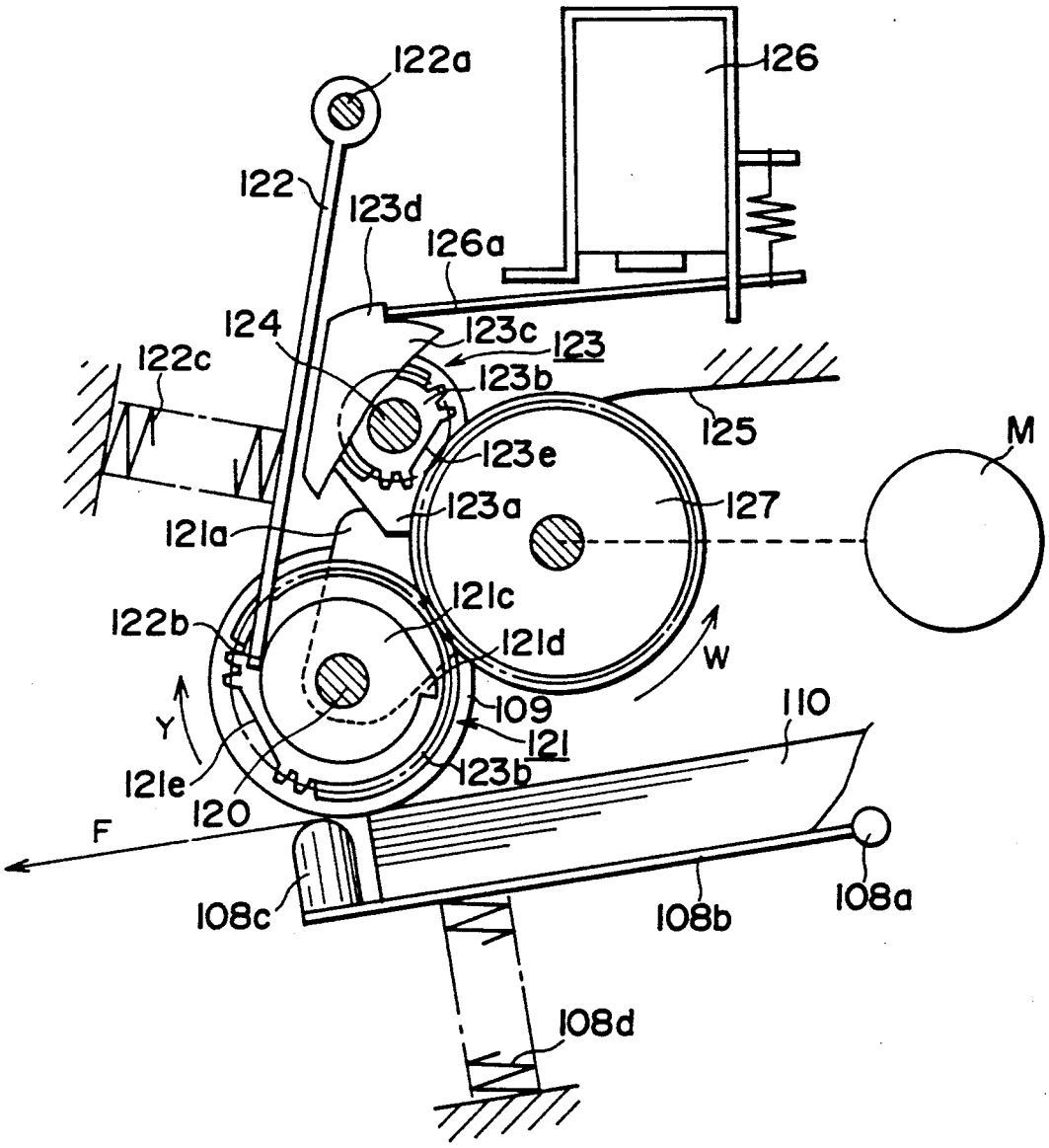

Since the second rotary member 123 rotates faster than the first rotary member 121, as started above, the notched portion 123e of the operation gear 123b reaches the transmission gear 127 faster than the notched portion 121e of the operation gear 121, as shown in FIG. 7. At that time, transmission of the driving force of the driving motor M to the second rotary member 123 is suspended, and the actuator 126a engages with the locking claw 123d of the locking member 123c again, and rotation of the second rotary member 123 is thereby suspended.

As the locking member 123c has been rotated and thereby separated from the stopper 122, the stopper 122, which is urged by the spring 122c, makes contact with the locking member 121c. In this state, the first rotary member 121 continues rotating. When the notched portion 121e reaches the transmission gear 127, as shown in FIG. 4, transmission of the driving force of the driving motor M to the first rotary member 121 is suspended. Also, the distal end portion 122b of the stopper 122 makes engagement with the locking claw 121d of the locking member 121c, and rotation of the first rotary member is thereby stopped.

Thus, the sheets 110 loaded on the inner plate 108b can be fed out in sequence one by one by rotating the sheet feed roller 109 intermittently which is achieved by turning on and off the solenoid 126.

This embodiment employs no spring clutch, unlike the conventional sheet feeding device. Therefore, neither the sintered parts nor lubricant oil is used, and reduction in the production cost can thus be made possible. Furthermore, noises are not generated during the driving force non-transmission period. Also, since the driving force is not transmitted from the transmission gear 127 to the first and second rotary members 121 and 123 during the non-transmission period, load can be reduced. This makes reduction in the size of the driving motor possible, thereby making reduction in the installation space of the motor and in the production cost possible.

In the second embodiment, the present invention has been applied to the laser beam printer. However, the present invention can be also be applied to another apparatuses, such as a coping machine or facsimile.

Another embodiments will now be described with reference to FIGS. 9 to 11.

Figure 9:
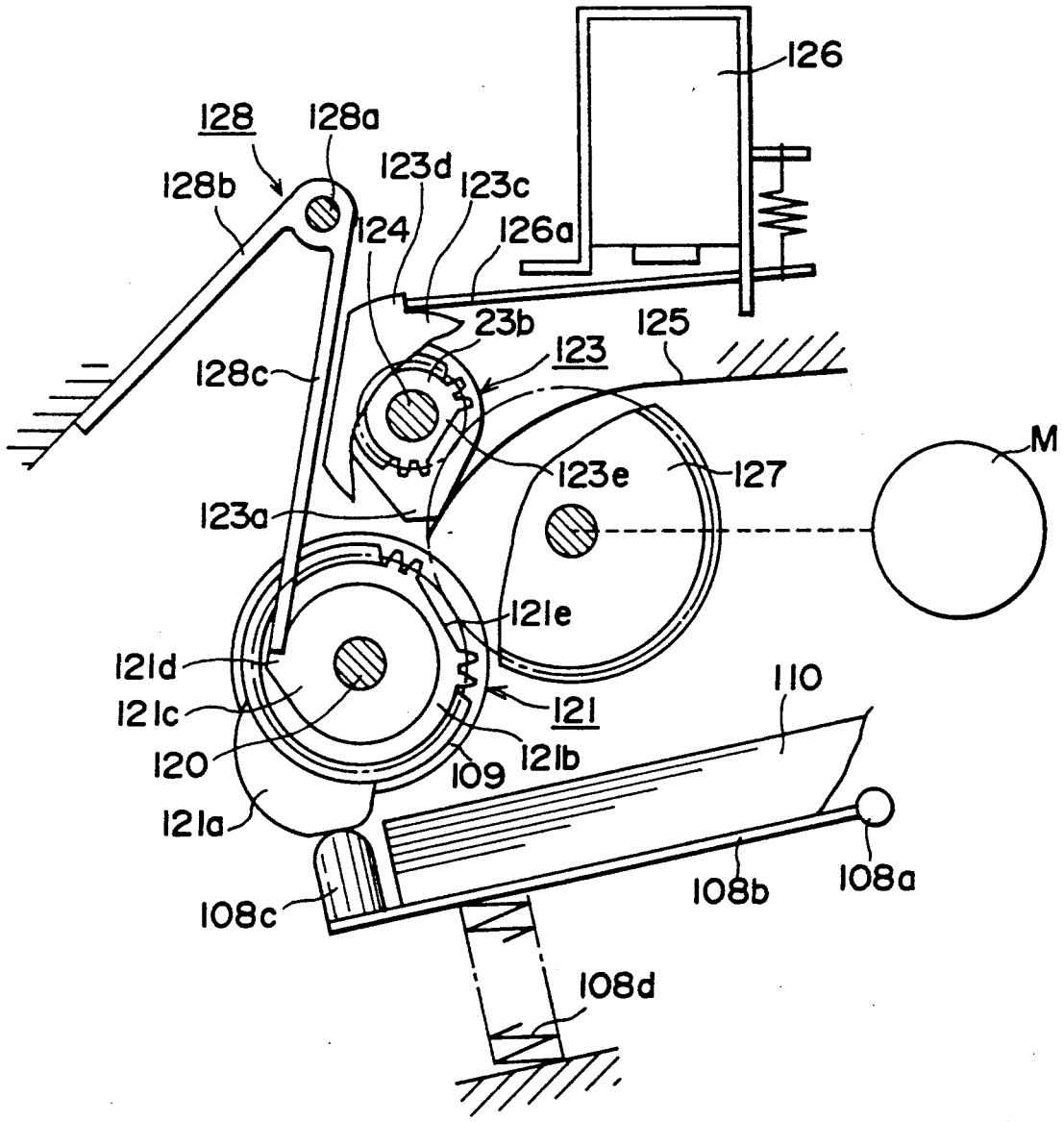
FIGS. 9 to 11 show another embodiments of the present invention.

In the embodiment shown in FIG. 9, a stopper 128 made of a synthetic resin as one unit is used as the locking member in place of the stopper 122 and the spring 122c which are used in the aforementioned second embodiment. The stopper 128 has a fixed piece 128b, and a locking piece 128c which can engage with the locking claw 121d of the locking member 121c.

In this embodiment, since the number of parts can be reduced, production cost can further be reduced.

Figure 10:
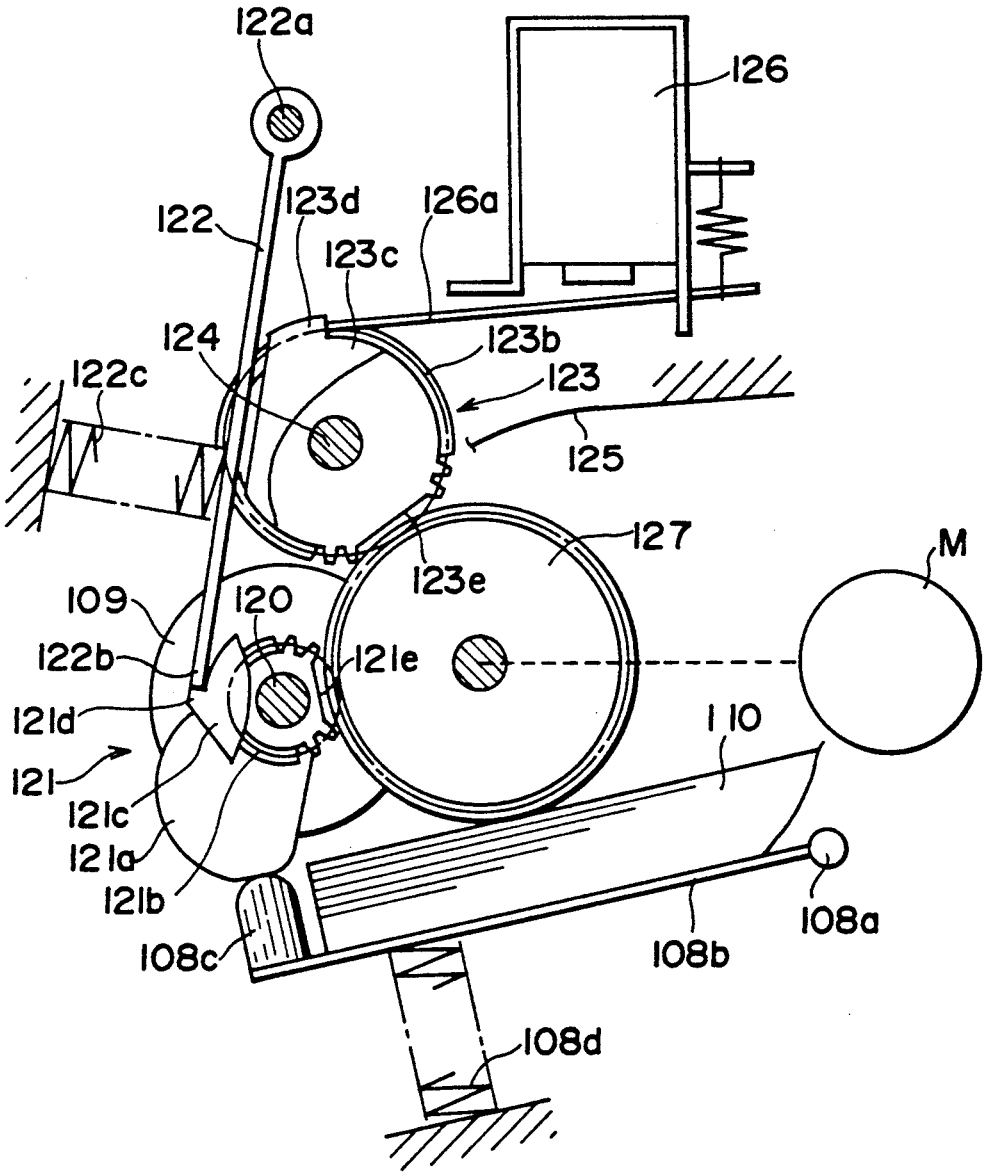

The embodiment shown in FIG. 10 is characterized in that the number of teeth of the operation gear 123b of the first rotary member 123 is greater than that of the operation gear 121b of the first rotary member 121. Therefore, the second rotary member 123 rotates slower than the first rotary member 121.

In that case, when the solenoid 126 is energized (turned on and off) instantaneously (within the time required for the second rotary member 123 to make one rotation), the actuator 126a is disengaged from the locking claw 123d, as stated above, and the second rotary member 123 starts rotating. Thereafter, the stopper 122 is disengaged from the locking claw 121d, and the first rotary member 121 starts rotating. As stated above, since the first rotary member 121 rotates slower than the second rotary member 123, the first rotary member 121 can make more than one rotation (e.g., two rotations) while the second rotary member 123 makes one rotation.

When the notched portion 123e faces the transmission gear 127 after the second rotary member 123 has made one rotation, the actuator 126a engages with the locking claw 123d, and rotation of the second rotary member 123 is thereby stopped. The stopper 122 engages with the locking claw 121d and rotation of the first rotary member 121 is thereby stopped after the first rotary member 121 has made two rotations.

In this embodiment, the sheet feeding force can be increased by rotating the sheet feed roller 109 the same number of times as that the first rotary member 121 makes rotation.

Figure 11:
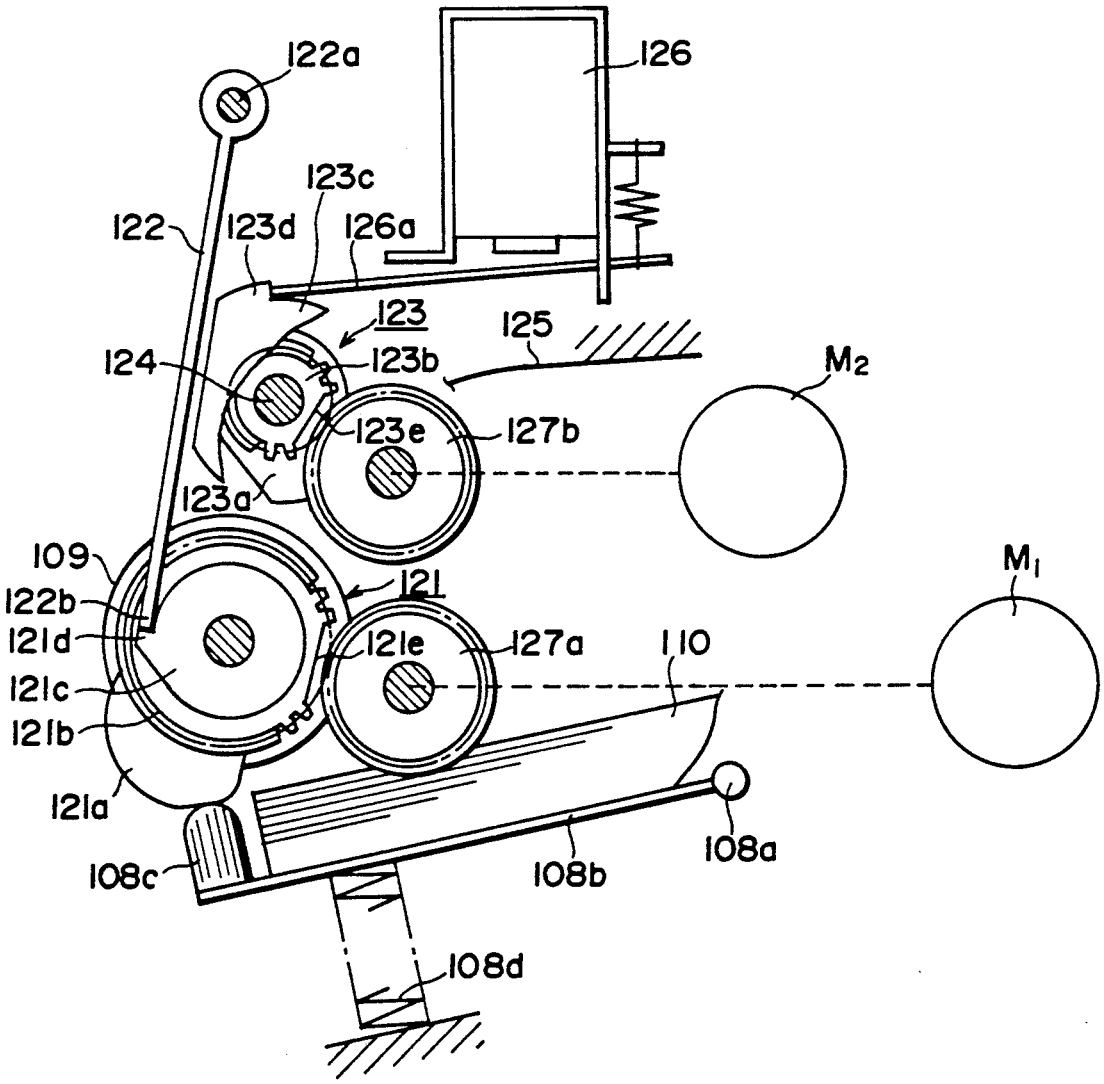
Figure 12:
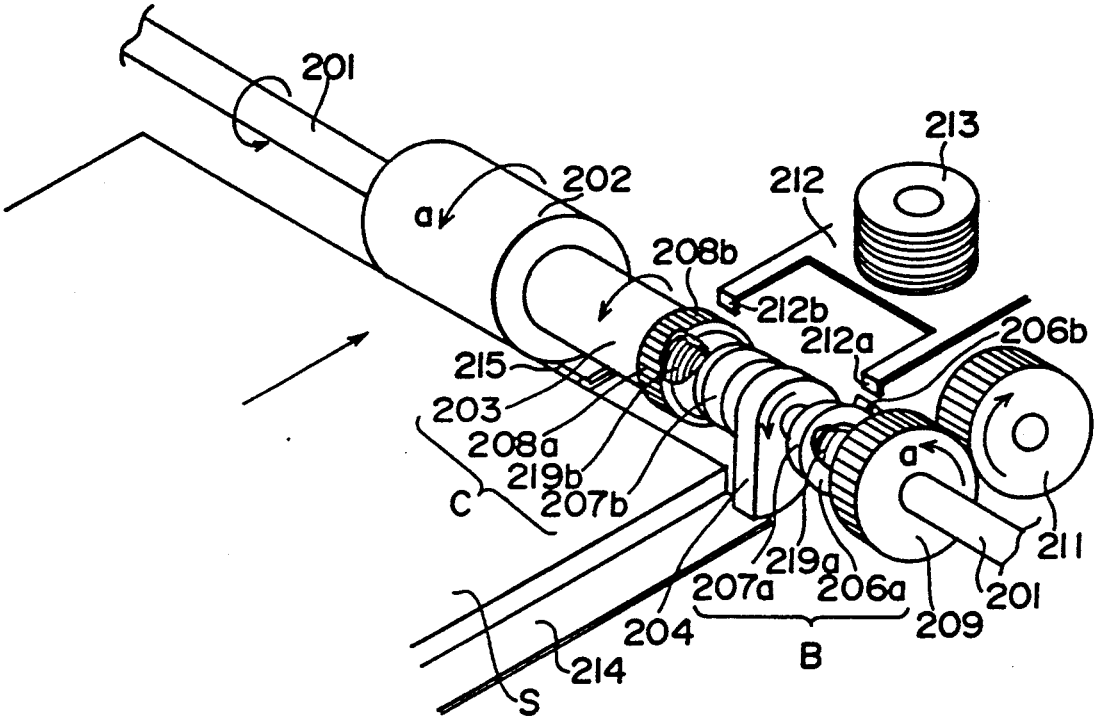
FIG. 12 PRIOR ART
FIG. 12 is a perspective view of a conventional sheet feeding device.
Figure 14:
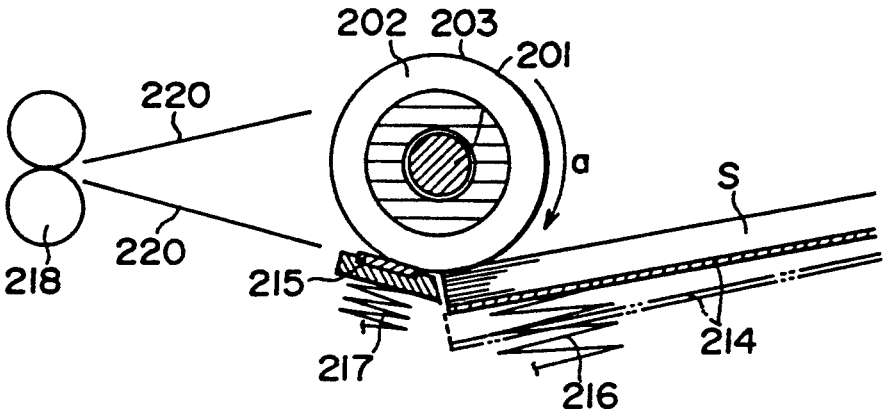
FIG. 14 PRIOR ART
FIG. 14 is a lateral cross-sectional view of the sheet feeding device of FIG. 12.
Figure 13:
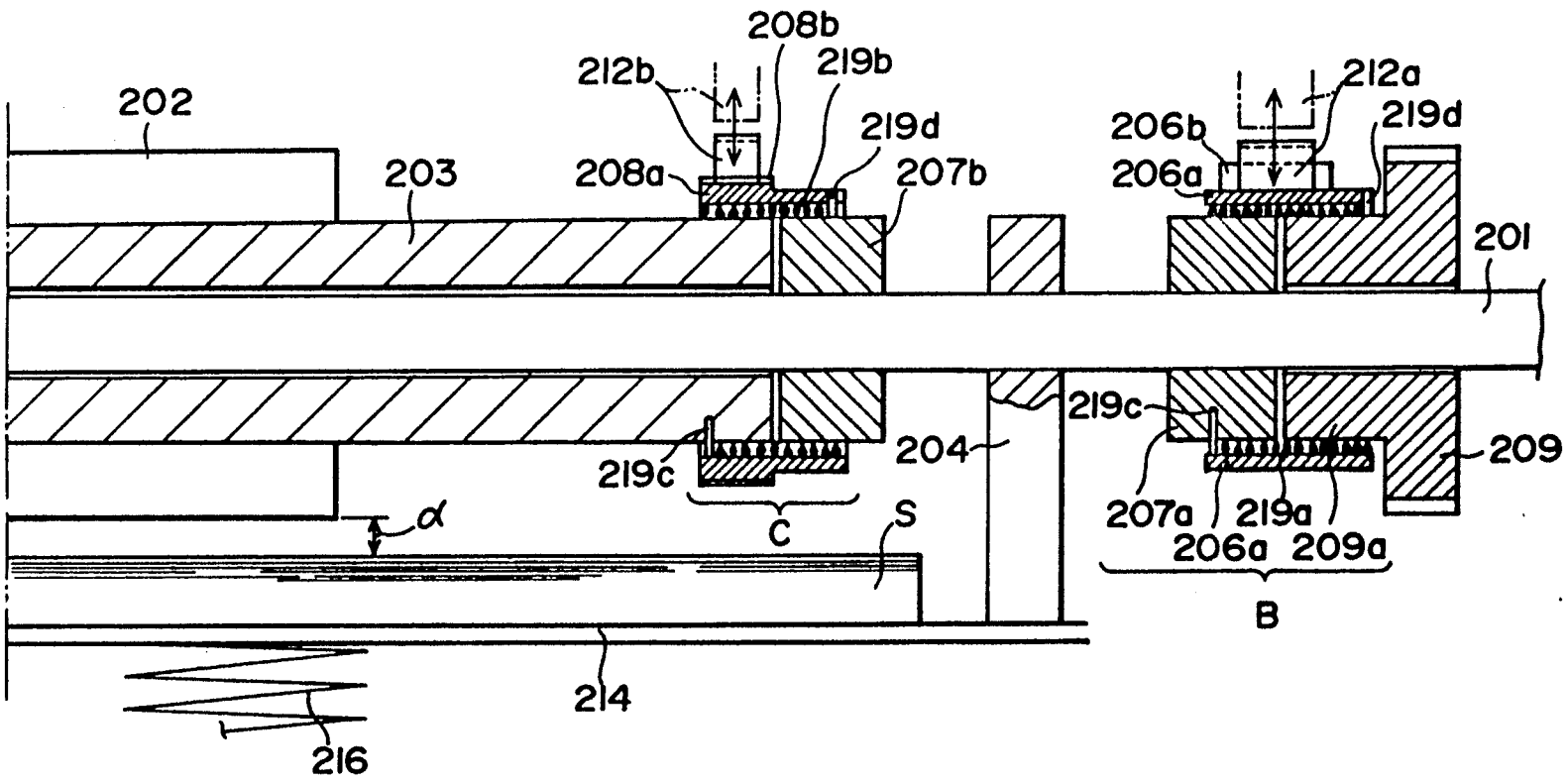
FIG. 13 PRIOR ART
FIG. 13 is a longitudinal cross-sectional view of the sheet feeding device of FIG. 12.
Figure 15:
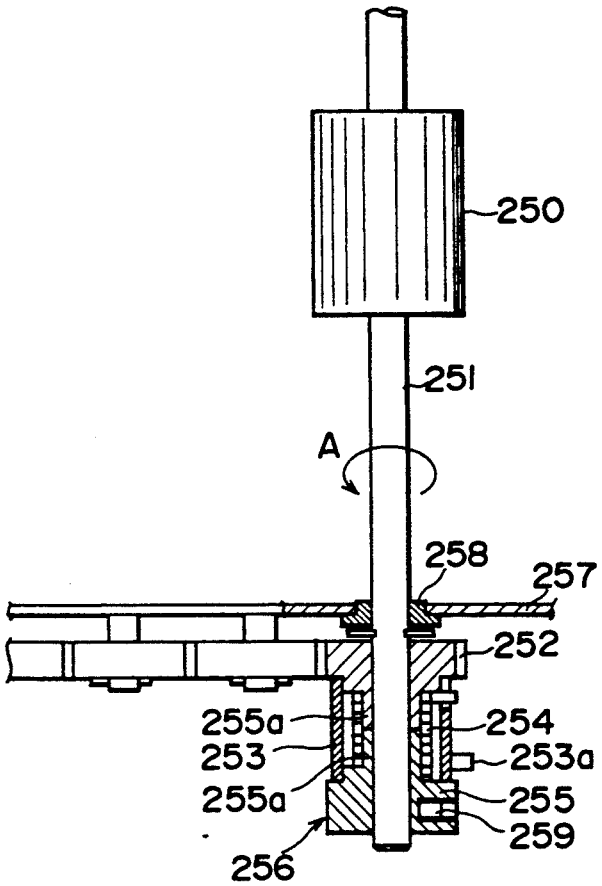
FIG. 15 PRIOR ART
FIG. 15 is a cross-sectional view of another example of the conventional sheet feeding device.
Figure 16:
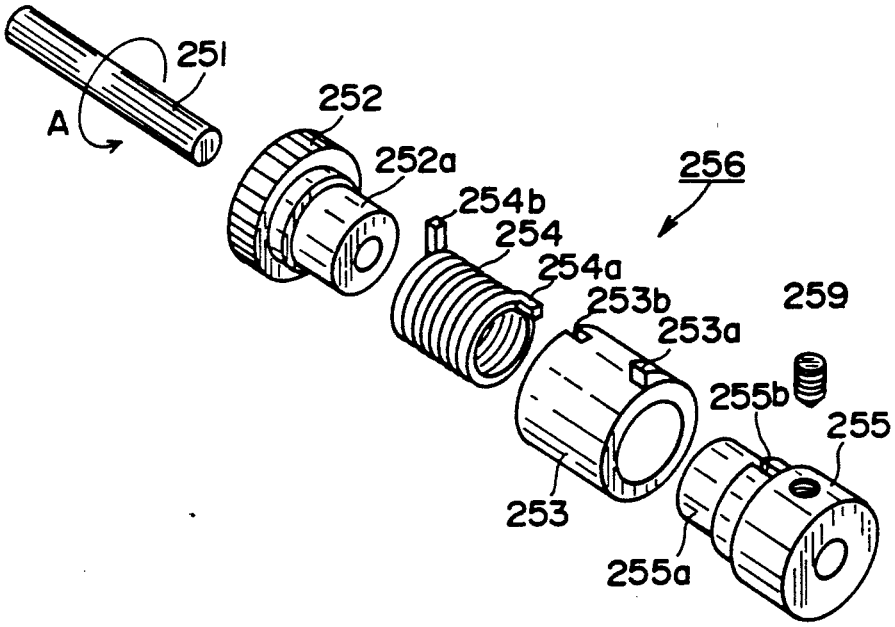
FIG. 16 PRIOR ART
FIG. 16 is an exploded perspective view of a clutch shown in FIG. 15.

In the embodiment shown in FIG. 11, the first and second rotary members 121 and 123 are respectively driven by separate driving motors M1 and M2 through transmission gears 127a and 127b.

In this case, the number of times the first rotary member 121 makes rotation while the second rotary member 123 makes one rotation can be changed by changing the rotational speeds of the driving motors M1 and M2. Consequently, versatility of the sheet feeding device can be improved.

In the above-described embodiments, since the driving control mechanism does not employ a spring clutch, the use of sintered parts or lubricant oil can be eliminated, thus reducing the production cost. Furthermore, noises are not generated during the driving force non-transmission period. Also, since the driving force is not transmitted from the driving source to the first and second rotary members, load can be reduced.

We claim:

1. A sheet feeding device, comprising:

a sheet accommodation means supporting a plurality of sheets and being movable between waiting and sheet feed positions;

an urging means for urging said sheet accommodation means toward the sheet feed position;

a sheet feed mean for feeding out the sheet supported by said sheet accommodation means at the sheet feed position;

a moving means for moving said sheet accommodation means between the waiting and sheet feed positions;

a driving force transmission means for transmitting a driving a force for moving said sheet accommodation means to said moving means when engaged with said moving means;

a release means for releasing the engagement of said moving means with said driving force transmission means; and a locking means for releasably restricting said moving means when the engagement of said moving means with said driving force transmission means is released by said release means;

wherein said moving means is brought into engagement with said driving force transmission means due to the urging force of said urging means, when restriction of said moving means by said locking means is released.

2. The sheet feeding device according to claim 1, wherein said moving means comprises a cam having a first cam portion for holding said sheet accommodation means to the waiting position which is separated from the sheet feed position, and a second cam portion for maintaining said sheet accommodation means at the sheet feed position located near said sheet feeding means.

3. The sheet feeding device according to claim 2, wherein said release means comprises a notched gear connected to said cam, the driving force being transmitted when a gear provided in said driving force transmission means is in mesh with said notched gear while transmission of the driving force being released when the gear of said driving force transmission means locates opposed to a notched portion of said notched gear.

4. The sheet feeding device according to claim 3, wherein said sheet accommodation means comprises an inner plate pivotal for loading the sheets, and said urging means comprises a spring for urging said inner plate toward the sheet feed position, said cam being rotated by said spring so as to rotate said notched gear and thereby bring said notched gear into mesh with said gear of said driving force transmission means when restriction of said cam by said locking means is released.

5. The sheet feeding device according to claim 4, wherein said sheet feeding means comprises a sheet feed roller mounted on a sheet shaft connected to a sheet feed driving source, said cam and said notched gear being provided separately from said sheet feed shaft.

6. The sheet feeding device according to claim 5, wherein said sheet feed shaft is connected to a clutch for controlling rotation of said sheet feed roller.

7. The sheet feeding device according to claim 6, wherein said driving force transmission means is connected to said sheet feed driving source, the driving force being transmitted from said sheet feed driving source to said cam to rotate said cam, when the gear of said driving force transmission means is brought into mesh with said notched gear.

8. The sheet feeding device according to claim 4, wherein said sheet feed means comprises a sheet feed shaft mounted on a sheet feed roller rotatably provided, said cam and said notched gear being fixed to said sheet feed shaft.

9. The sheet feeding device according to claim 8, wherein said sheet feed roller is rotated by the driving force transmitted to said cam when the gear of said driving force transmission means is engaged with said notched gear to thereby feed out the sheets supported by said inner plate.

10. The sheet feeding device according to claim 1, further comprising a claw member engaged with said moving means to restrict rotation thereof, and an actuator for moving said claw member between a position where said claw member is engaged with said moving means and a position where said claw member is disengaged from said moving means.

11. The sheet feeding device according to claim 1, further comprising a separation means for separating the sheets fed out by said sheet feeding means from each other.

12. The sheet feeding device according to claim 11, wherein said separation means comprises a friction pad which contacts with said sheet feed means to separate the sheets from each other in cooperation with said sheet feed means.

13. A sheet feeding device comprising:

a sheet accommodation means supporting a plurality of sheets and being movable between a waiting position and a sheet feed position;

an urging means for urging said sheet accommodation means toward said sheet feed position;

a sheet feeding means for feeding out the sheets supported by said sheet accommodation means at the sheet feed position;

a moving means for moving said sheet accommodation means between the waiting position and sheet feed position;

a first driving force transmission means for transmitting a driving a force for moving said sheet accommodation means to said moving means when engaged with said moving means;

a release means for releasing the engagement of said moving means with said first driving force transmission means;

a locking means for restricting said moving means when the engagement of said moving means with said first driving force transmission means is released by said release means;

a lock release means for releasing restriction of said locking member by the driving force; and a second driving force transmission means for transmitting the driving force to said lock release means;

wherein said moving means is brought into engagement with said first driving force transmission means by an urging force of said urging means, when said lock release means releases restriction of said moving means by said locking member by the driving force from said second driving force transmission means.

14. The sheet feeding device according to claim 13, wherein said moving means comprises a cam having a first cam portion for holding said sheet accommodation means to the waiting position which is separated from the sheet feed position, and a second cam portion for maintaining said sheet accommodation means at the sheet feed position located near said sheet feed means.

15. The sheet feeding device according to claim 14, wherein said release means comprises a notched gear connected to said cam, the driving force being transmitted when a gear provided in said first driving force transmission means is in mesh with said notched gear while transmission of the driving force being released when the gear of said first driving force transmission means locates opposed to a notched portion of said notched gear.

16. The sheet feeding device according to claim 15, wherein said sheet accommodation means comprises an inner plate pivotal for loading the sheets, and said urging means comprises a spring for urging said inner plate toward the sheet feed position, said cam being rotated by said spring so as to rotate said notched gear and thereby bring said notched gear of said first driving force transmission means into mesh with said gear when restriction of said cam by said locking member is released.

17. The sheet feeding device according to claim 13, wherein said lock release means comprises a cam having a cam portion for maintaining a state in which said locking member restricts said moving means, and a cam portion for releasing restriction of said locking member by displacing said locking member;

a second release means for releasing the engagement of said cam with said second driving force transmission means; and a locking means for restricting said cam when the engagement of said cam with said second driving force transmission means is released by said second release means.

18. The sheet feeding device according to claim 17, wherein said second release means comprises a notched gear connected to said cam, the driving force being transmitted when a gear provided in said second driving force transmission means is in mesh with said notched gear, while transmission of the driving force being released when the gear of said second driving force transmission means locates opposed to a notched portion of said notched gear.

19. The sheet feeding device according to claim 18, further comprising an urging means for urging said notched gear in a direction in which said notched gear is rotated to thereby bring it into mesh with said gear of said second driving force transmission means when restriction of said locking means is released.

20. The sheet feeding device according to claim 17, wherein said locking means comprises a claw member engaged with said cam to restrict rotation of said cam, and an actuator for moving said claw member between a position where said claw member is engaged with said cam and a position where said claw member is disengaged from said cam.

21. The sheet feeding device according to claim 13, wherein said first driving force transmission means and said second driving force transmission means are the same.

22. The sheet feeding device according to claim 13, further comprising a separation means for separating the sheet fed out by said sheet feeding means from each other.

23. The sheet feeding device according to claim 22, wherein said separation means comprises a friction pad which contacts with said sheet feeding means to separate the sheets from each other in cooperation with said sheet feeding means.

24. An image forming apparatus comprising:

a sheet accommodation means supporting a plurality of sheets and being movable between waiting position and a sheet feed position;

an urging means for urging said sheet accommodation means toward said sheet feed position;

a sheet feeding means for feeding out the sheets supported by said sheet accommodation means at the sheet feed position;

a moving means for moving said sheet accommodation means between the waiting and sheet feed position;

a first driving force transmission means for transmitting a driving a force for moving said sheet accommodation means to said moving means when engaged with said moving means;

a release means for releasing the engagement of said moving means with said first driving force transmission means;

a locking means for restricting said moving means when the engagement of said moving means with said first driving force transmission means is released by said release means;

a separation means for separating the sheets fed out from said sheet accommodation means by means of said sheet feeding means from each other when said sheet accommodation means has been moved to said sheet feed position by means of said moving means; and an image formation means for forming an image on the sheet separated by said separation means;

wherein said moving means is brought into engagement with said first driving force transmission means by an urging force of said urging means when restriction of said moving means by said locking means is released.

25. The image forming apparatus according to claim 24, wherein said separation means comprises a friction means which contacts with said sheet feeding means to separate the sheets from each other in cooperation with said sheet feeding means.

26. An image forming apparatus comprising:

a sheet accommodation means supporting a plurality of sheets and being movable between a waiting position and a sheet feed position;

an urging means for urging said sheet accommodation means toward said sheet feed position;

a sheet feeding means for feeding out the sheets supported by said sheet accommodation means at the sheet feed position;

a moving means for moving said sheet accommodation means between the waiting and sheet feed positions;

a first driving force transmission means for transmitting a driving a force for moving said sheet accommodation means to said moving means when engaged with said moving means;

a release means for releasing the engagement of said moving means with said first driving force transmission means;

a locking means for restricting said moving means when the engagement of said moving means with said first driving force transmission means is released by said release means;

a lock release means for releasing restriction of said locking member by the driving force;

a second driving force transmission means for transmitting the driving force to said lock release means;

a separation maens for separating the sheets fed out form said sheet accommodation means by means of said sheet feeding means from each other when said sheet accommodation means has been moved to the sheet feed position by means of said moving means; and an image formation means for forming an image on the sheet separated by said separation means;

wherein said moving means is brought into engagement with said first driving force transmission means by an urging force of said urging means, when said lock release means releases restriction of said moving means by said locking member by the driving force from said second driving force transmission means.

27. The image forming apparatus according to claim 26, wherein said separation means comprises a friction means which contacts with said sheet feeding means to separate the sheets from each other in cooperation with said sheet feeding means.

* * * * *

UNITED STATES PATENT AND TRADEMARK OFFICE

CERTIFICATE OF CORRECTION

PATENT NO. : 5,240,242

DATED : August 31, 1993

INVENTOR(S) : Masao ANDO, et al.

It is certified that error appears in the above-indentified patent and that said Letters Patent is hereby corrected as shown below:

Column 4
Line 27, "mechanism" should read --mechanisms--.

Column 5
Line 43, "means," should read --means--.

Column 7
Line 31, "another" should read --other--.

Column 8
Line 22, "and" should read --are--.

Column 9
Line 56, "moment FA" should read --moment Fa--.

Column 13
Line 4, "started" should read --stated--,
Line 47, "Another" should read --Other--.

Column 14
Line 46, "mean" should read --means--.

Column 16
Line 1, "means" should read --means for--,
Line 19, "means" should read --member--,
Line 40, "feed" should read --feeding--,
Line 56, "of said first driving" should be deleted,
Line 57, "force transmission means" should be deleted and, "gear" should read --gear of said first driving force transmission means--.

UNITED STATES PATENT AND TRADEMARK OFFICE

CERTIFICATE OF CORRECTION

PATENT NO. : 5,240,242

DATED : August 31, 1993

INVENTOR(S) : Masao ANDO, et al.

It is certified that error appears in the above-indentified patent and that said Letters Patent is hereby corrected as shown below:

Column 17

Line 42, "between" should read --between a --.

Column 18

Line 30, "a" (second occurrence) should be deleted,
Line 44, "maens" should read --means--,
Line 45, "form" should read --from--,
Line 54, "means," should read --means--,
Line 56, "member" should read --means--.
Line 54, "an" should read --the--

Signed and Sealed this

Third Day of May, 1994

Bruce Lehman

*Attest:*

BRUCE LEHMAN

*Attesting Officer*

*Commissioner of Patents and Trademarks*